US008117717B2

(12) United States Patent
Perche

(10) Patent No.: US 8,117,717 B2
(45) Date of Patent: Feb. 21, 2012

(54) TEMPORARY DEVICE FOR SPACING AN OPENING ELEMENT WITH RESPECT TO A FIXED ELEMENT

(75) Inventor: Stephane Perche, Saint Bardoux (FR)

(73) Assignee: Exsto Thermoplastiques, Romans sur Isere (FR)

( * ) Notice: Subject to any disclaimer, the term of this patent is extended or adjusted under 35 U.S.C. 154(b) by 424 days.

(21) Appl. No.: 11/921,175

(22) PCT Filed: Jun. 30, 2006

(86) PCT No.: PCT/FR2006/001535

§ 371 (c)(1),
(2), (4) Date: Jan. 23, 2008

(87) PCT Pub. No.: WO2007/003776

PCT Pub. Date: Jan. 11, 2007

(65) Prior Publication Data

US 2009/0165253 A1 Jul. 2, 2009

(30) Foreign Application Priority Data

Jun. 30, 2005 (FR) ..... 05 06677

(51) Int. Cl.
*E05F 5/02* (2006.01)

(52) U.S. Cl. ..... 16/82; 118/500; 118/503; 269/315; 427/300

(58) Field of Classification Search ..... 16/82, 49, 16/DIG. 17; 109/63.5; 292/341.12; 118/500, 118/503; 269/315; 24/545; 427/300; 296/146.9, 296/50, 56, 57.1, 76, 193.08, 193.11; 180/69.2, 180/69.21

See application file for complete search history.

(56) References Cited

U.S. PATENT DOCUMENTS

| | | | | |
|---|---|---|---|---|
| 5,582,446 | A * | 12/1996 | Walker, Jr. | 292/288 |
| 5,675,865 | A * | 10/1997 | van der Steur | 16/82 |
| 6,086,958 | A * | 7/2000 | Russell et al. | 427/385.5 |
| 6,248,172 | B1 * | 6/2001 | Shirotani et al. | 118/500 |
| 6,360,407 | B1 * | 3/2002 | Webster et al. | 24/570 |
| 6,656,278 | B2 * | 12/2003 | Baisch | 118/500 |
| 2003/0015135 | A1 | 1/2003 | Baisch | |

FOREIGN PATENT DOCUMENTS

| | | |
|---|---|---|
| DE | 38 35 810 A1 | 4/1990 |
| EP | 0 931 895 B1 | 6/2002 |
| FR | 2 833 562 A1 | 6/2003 |

* cited by examiner

*Primary Examiner* — William L. Miller
(74) *Attorney, Agent, or Firm* — Oliff & Berridge, PLC

(57) ABSTRACT

The invention relates to a temporary device (1, 20) for spacing an opening element (6) with respect to a fixed element (3) of the vehicle body comprising a fixing plate for anchoring the device on the fixed element and a body which is connected to the fixing plate and forms an abutment (4) for supporting the opening element, wherein at least one part of the abutment is elastically deformable by forces produced by the opening element in the longitudinal direction thereof.

6 Claims, 3 Drawing Sheets

TEMPORARY DEVICE FOR SPACING AN OPENING ELEMENT WITH RESPECT TO A FIXED ELEMENT

BACKGROUND

The present invention relates to a temporary device for spacing an opening element with respect to a fixed element of a vehicle body.

Before permanent attachment of an opening element, such as a door, hood or tailgate, among others, with respect to a fixed element of a vehicle body, one generally applies one or several coatings, such as protective coatings or a layer of paint. During treatments of this type, these opening elements are not yet equipped with permanent closure devices, such as locks.

For this reason, temporary spacing devices are used which make it possible to maintain an opening element in its closed position with regard to the fixed element to which it must be attached.

Documents EP 0 931 895 and FR 2 833 562 each describe a device of this type comprising, on one hand, a fixing plate for anchoring the device on the fixed element, and on the other hand, a body attached to the fixing plate and forming an abutment for supporting the opening element.

However, one of the drawbacks of these devices is their poor ability to sustain the stresses and forces exerted by the element held open. Indeed, opening elements of the car door, tailgate and hood types, among others, are fairly heavy elements which are generally manipulated somewhat imprecisely and not very carefully during their installation or during transport of the vehicle body along the assembly line. These kinds of manipulations risk causing a large number of shocks between the temporary spacing device and the opening element, leading to damages to the metal and/or abutment of this temporary spacing device. These problems may also come from devices provided on the vehicle itself or located on the assembly line.

SUMMARY

The present invention aims to resolve the aforementioned drawbacks and therefore consists of a temporary device for spacing an opening element with respect to a fixed element of a vehicle body, and comprising, on one hand, a fixing plate for anchoring the device on the fixed element, and on the other hand, a body connected to the fixing plate and forming an abutment for supporting the opening element, at least one part of the abutment being elastically deformable by forces produced by the opening element, characterized in that the deformable part of the abutment is deformable in the longitudinal axis thereof.

The term "opening element" is intended to designate any part of a vehicle body, such as a door, hood or tailgate, which is mobile with respect to the vehicle body.

Thus, making one part of the abutment elastically deformable in a longitudinal direction enables absorption of the shocks taking place with the opening element during the operation. In this way, resistance to stresses is greatly improved and any deformation of the opening element or breakage of the temporary spacing device due to a shock is avoided.

Also advantageously, the deformable part of the abutment is laterally deformable on either side of the longitudinal axis of the latter.

Preferably, the abutment cooperates with a housing of the opening element through complementary shapes.

Advantageously, the abutment can be broken down into a base connected to the fixing plate, and a head supporting the opening element and which is elastically deformable by forces produced by the opening element.

Preferably, the head has a substantially rounded exterior surface in cross-section. This type of shape enables improved distribution of the stresses exerted on the abutment. Also preferably, the head has a constant cross-section over its height.

Advantageously, the base is connected to the head by a throttle region. Said throttle grants a relatively stiff material a certain degree of flexibility at a given point while preserving great mechanical solidity for the rest of the abutment.

Preferably, the deformable part of the abutment has a deformation amplitude in the vicinity of 4 mm, or 2 mm on both sides of the abutment for a lateral deformation. This is the positioning tolerance generally allowed for an opening element of a vehicle body. Moreover, the abutment is preferably made of an injected thermoplastic material able to resist temperatures of 200° C. This is generally the temperature of the furnaces used to dry a previously-applied coating product.

Advantageously, the body forming the abutment is a single piece. Also advantageously, the device is a single piece.

Preferably, the temporary spacing device comprises an elastic retaining pin cooperating with one edge of the opening element to prevent it from opening. This pin ensures locking of the opening element in a closed position with regard to the fixed element. Thus, during movement of the fixed element along an assembly line, the opening element is maintained in its position and does not risk opening.

BRIEF DESCRIPTION OF THE DRAWINGS

The implementation of the invention will be better understood with the help of the detailed description provided below with regard to the appended drawing in which.

DETAILED DESCRIPTION

Figure 1:
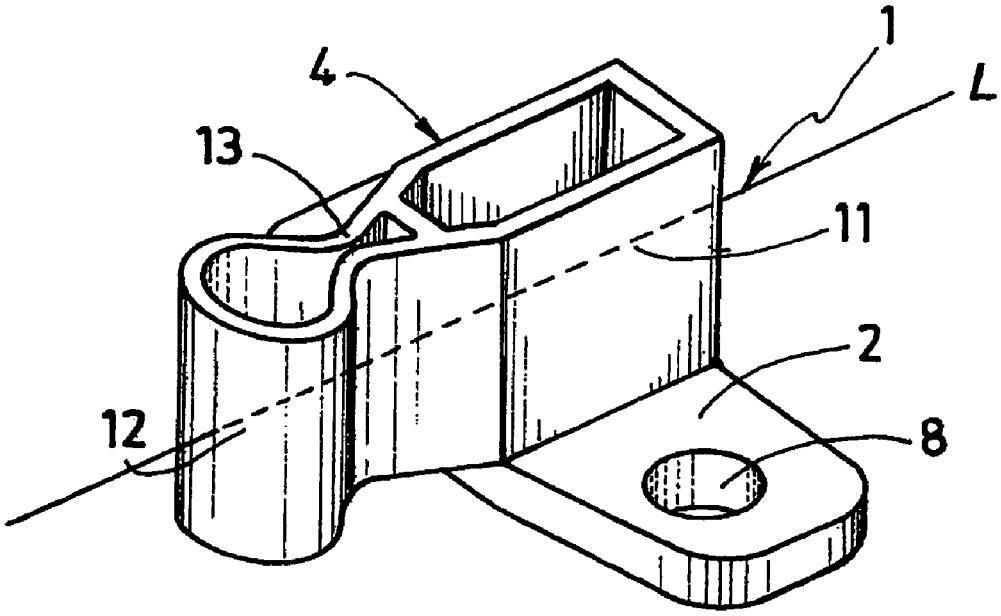
FIG. 1 is a perspective view of a temporary spacing device according to the invention.
Figure 2:
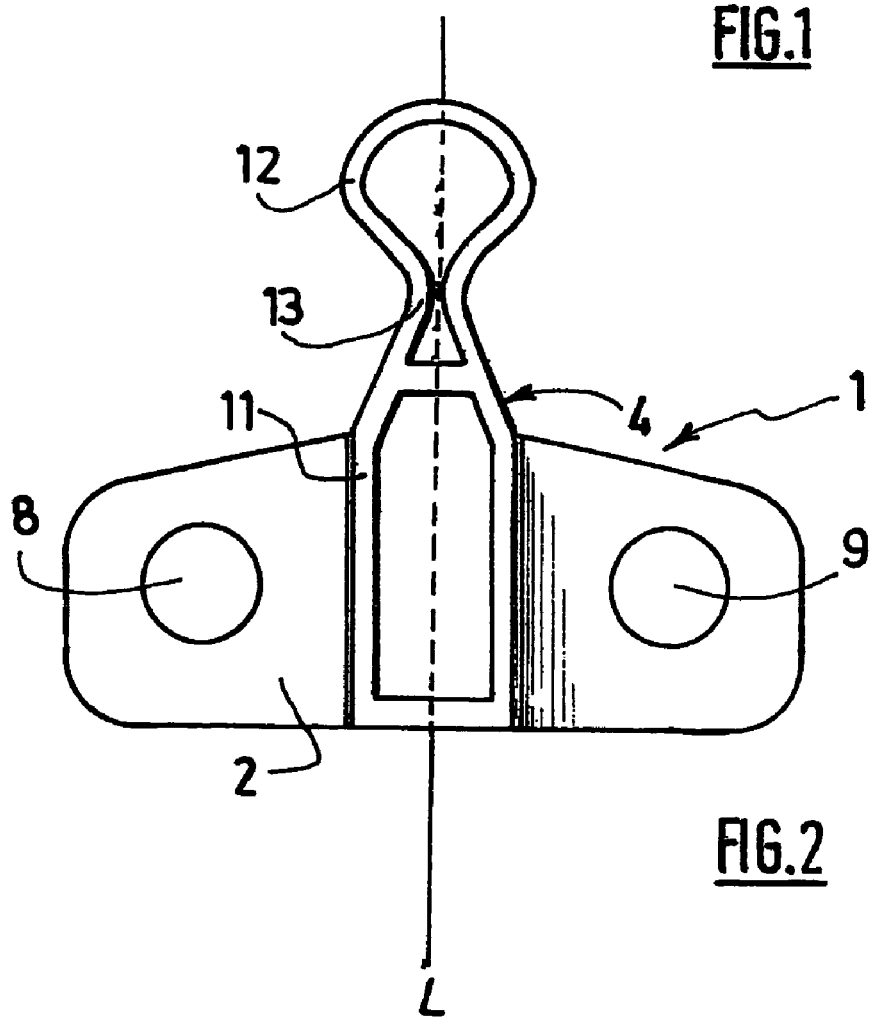
FIG. 2 is a top view of the device from FIG. 1.
Figure 3:
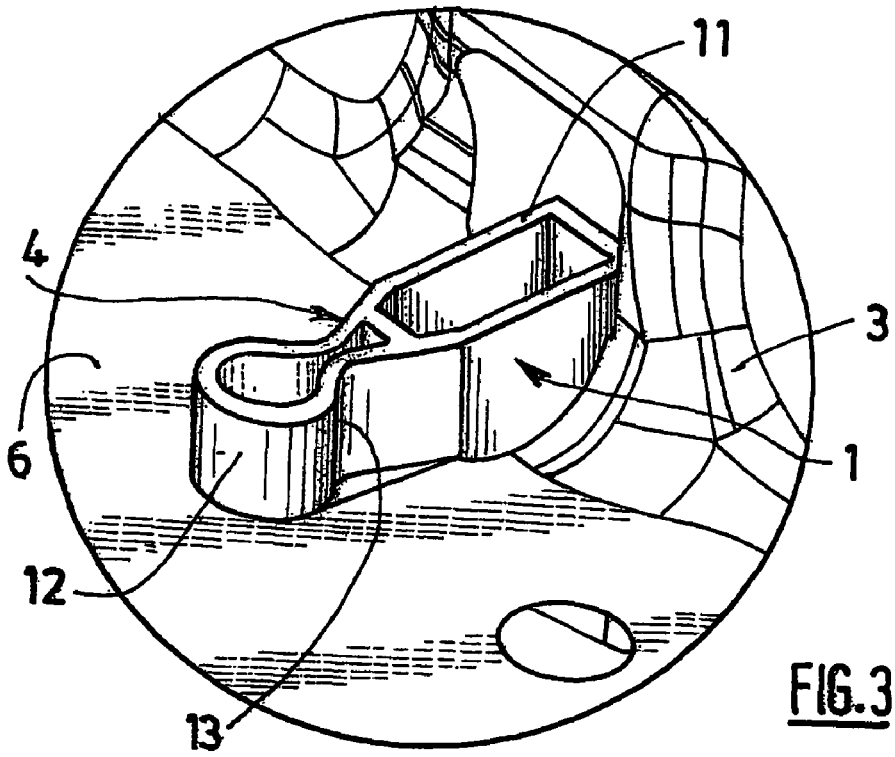
FIG. 3 is a view of the device from FIG. 1 anchored in a fixed element of a vehicle body and supporting an opening element.
Figure 4:
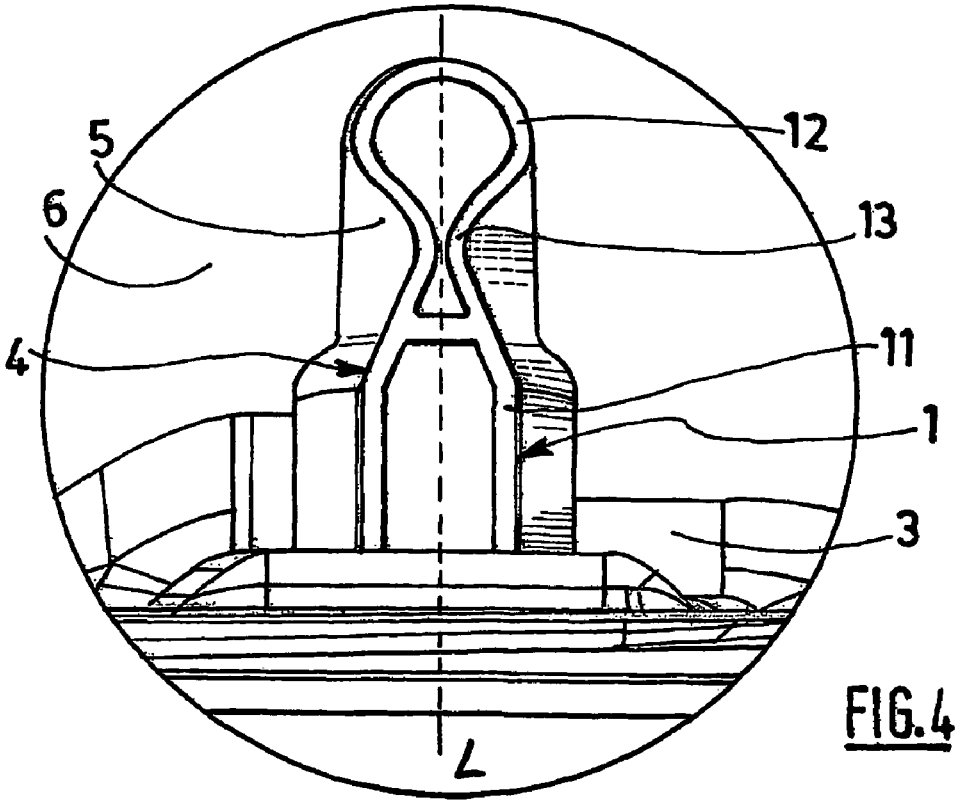
FIG. 4 is a diagrammatic top view of the device illustrated in FIG. 3.

A temporary spacing device 1 according to the invention, as illustrated in FIGS. 1 to 4, comprises a single-piece body made of a shaped thermoplastic material, and which breaks down, on one hand, into a fixing plate 2 for temporary anchoring of the device 1 in a fixed element 3 of a vehicle body, and on the other hand, into an abutment 4 extending perpendicularly and laterally from the fixing plate 2 along a longitudinal axis L and supporting an opening element 6.

The fixing plate 2 is equipped with attaching means comprising holes 8, 9 each designed to receive a corresponding screw 25.

The abutment 4 is generally nine-pin shaped and has a substantially parallelepiped base 11 extending vertically to the fixing plate 2, and a substantially cylindrical head 12 connected to the base 11 by a narrowing cross-section 13 forming a throttle region. This narrowing cross-section 13 grants the abutment 4, and more precisely its head 12, on one hand, lateral flexibility on both sides of the longitudinal axis L of the abutment 4, and on the other hand, longitudinal flexibility, i.e. along the longitudinal axis L of the abutment 4, the rounded cross-section of the head 12 then enabling optimal distribution of stresses.

Figure 5:
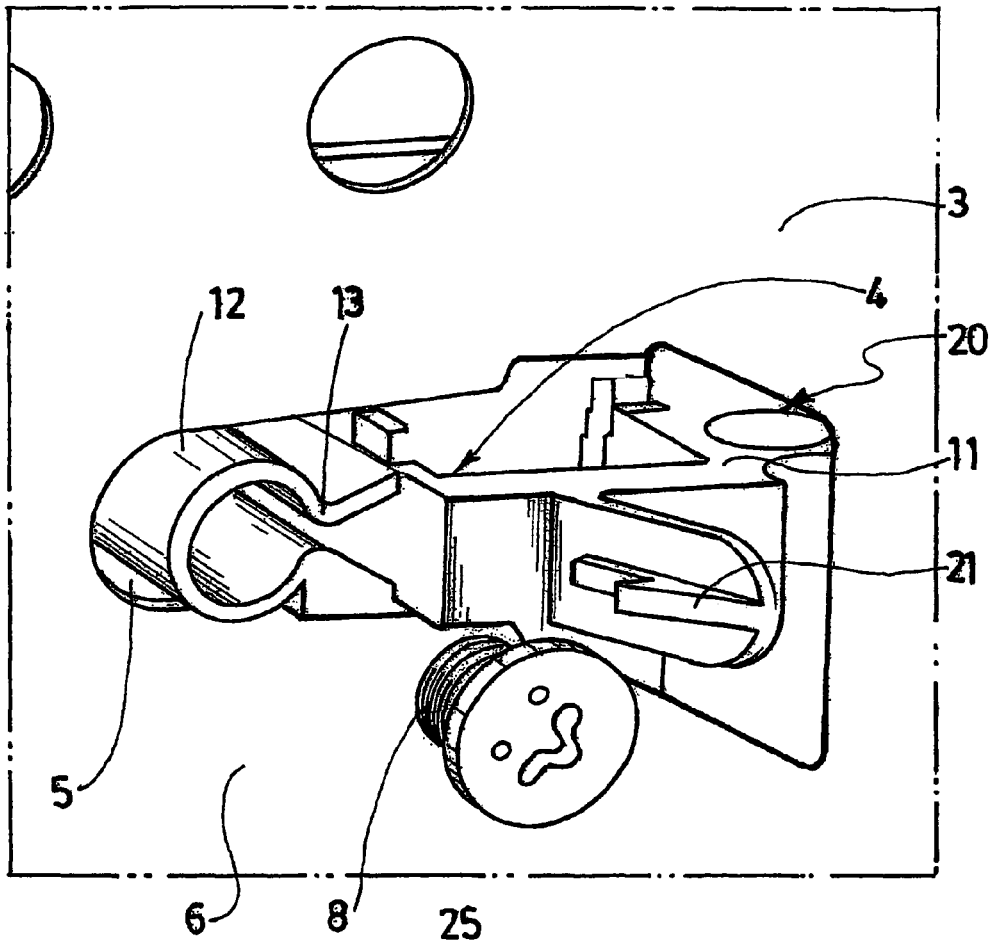
FIG. 5 is an illustration of one variation of a temporary spacing device according to the invention equipped with an elastic retaining pin.

A temporary spacing device 20 as illustrated in FIG. 5 differs from the previously-described temporary spacing device 1, because it has a locking function thanks to an elastic retaining pin 21 attached to one side of the abutment 4 and cooperating with one edge of the housing 5 of the opening element 6 to prevent it from opening during the coating stage.

A user wishing to maintain the opening element 6 in a slightly spaced position with regard to a closed position of an opening element on a fixed element 3 of a vehicle body will proceed as follows.

Initially, the fixed element 3 of the body is placed on an assembly line along which it moves so as to undergo various assembly operations. This fixed element 3 has openings for receiving opening elements 6, such as doors, a tailgate or a hood. These openings each define, with regard to the fixed element 3 of the body, a plane, for example substantially vertical in the case of a door, in which the hinging direction is found.

During these assembly operations, the opening elements 6 are mounted on the fixed element 3 with the help of suitable hinges. However, these opening elements 6 are not yet equipped with closure devices and permanent locks. When the body is ready to receive a coat of paint or a protective coating, the opening elements 6 must be placed in a position close to their closure position.

These opening elements 6 are maintained in a position of this type with the help of the temporary spacing and locking device 1, 20 according to the invention.

To do this, the temporary spacing device 1, 20 is anchored, with the help of screws 25 gong through the holes 8, 9 of the fixing plate 2, in the fixed element 3 in a fixing zone (not visible). The fixing plate 2 defines an anchoring plane substantially parallel to the plane defined by the opening in the fixed element 3 corresponding to the opening element 6 which one wishes to support and in which the longitudinal axis L of the abutment 4 is located.

More specifically, the temporary spacing device 1, 20 is intended to be temporarily fixed in place of a lock of the opening element 6, the fixing plate 2 then being fixed in the fixed element 3 of a strike, while the abutment 4 is intended to be introduced in a housing 5 of the opening element 6 formed by a space designed to receive the permanent lock.

Once the temporary spacing device 1, 20 is thus installed, the opening element 6 is brought into its closed position such that the head 12 of the abutment 4 of the temporary spacing device 1, 20 enters the housing 5 designed for the permanent lock of the opening element 6.

In so doing, the opening element 6 bears on the head 12 of the abutment 4, which supports and maintains it in the desired position.

During transport of the body through the application zone of the coating or paint, during installation of the opening element 6, and during any other manipulations, the opening element 6 is likely to be subjected to outside forces which cause it to strike the device(s) 1, 20 maintaining it. The lateral and longitudinal flexibility granted by the head 12 to the abutment 4 make it possible to absorb these potential shocks directed toward the top or bottom of the opening element 6, respectively, and toward the right or left of the opening element 6, and thus to prevent them from causing deformation of the opening element 6 and a potential break of the abutment 4.

Advantageously, the opening element 6 can be locked in the closed position using the elastic retaining pin 21 of the temporary spacing device 20.

Once the coating or paint has been applied, the temporary spacing devices 1, 20 are removed and the permanent closure devices and locks can be installed.

Although the invention has been described with regard to particular examples of embodiments, it is obviously in no way limited to them and it includes all technical equivalents for the means described as well as their combinations in the event said combinations fall within the scope of the invention.

The invention claimed is:

1. Temporary device for spacing an opening element with respect to a fixed element of a vehicle body, comprising:

a fixing plate anchoring the device in the fixed element of the vehicle body; and an abutment extending perpendicularly from the fixing plate, the abutment extending laterally from the fixing plate along a longitudinal axis of the abutment, and having a base and a head, the head of the abutment having a rounded cross-section and being connected to the base by a narrowing cross-section forming a throttle region, the head being elastically deformable by forces produced by the opening element, wherein the throttle region provides the head lateral flexibility on both sides of the longitudinal axis of the abutment, and longitudinal flexibility along the longitudinal axis of the abutment, and the rounded cross-section of the head provides distribution of stress during impact with the opening element.

2. Device according to claim 1, wherein the head of the abutment laterally deforms substantially symmetrically on both sides of the longitudinal axis of the abutment.

3. Device according to claim 1, wherein the abutment has a shape that substantially corresponds to shape of a housing in the opening element.

4. Device according to claim 1, wherein the head of the abutment has a deformation amplitude of approximately 4 mm.

5. Device according to claim 1, wherein the abutment is formed as a single piece.

6. Device according to claim 1, further comprising an elastic retaining pin cooperating with one edge of the opening element to prevent the opening element from opening.

* * * * *